United States Patent [19]

Gerken et al.

[11] Patent Number: 4,713,219

[45] Date of Patent: Dec. 15, 1987

[54] PLASTIC REACTION VESSEL

[75] Inventors: Hero Gerken; Heinz-Jürgen Gora, both of Hamburg, Fed. Rep. of Germany

[73] Assignee: Eppendorf Geratebau Netheler & Hinz GmbH, Hamburg, Fed. Rep. of Germany

[21] Appl. No.: 921,866

[22] Filed: Oct. 20, 1986

Related U.S. Application Data

[63] Continuation of Ser. No. 686,198, Dec. 26, 1984, abandoned.

[30] Foreign Application Priority Data

Jan. 24, 1984 [DE] Fed. Rep. of Germany ..... 3402276

[51] Int. Cl.[4] ..... B01L 3/00

[52] U.S. Cl. ..... 422/102; 215/237; 220/339

[58] Field of Search ..... 422/57, 58, 102; 215/237, 272, 306, 355; 220/307, 336, 339

[56] References Cited

U.S. PATENT DOCUMENTS

| | | | |
|---|---|---|---|
| 3,593,909 | 7/1971 | Bergman | 229/43 |
| 4,158,902 | 6/1979 | Chernack et al. | 220/339 |
| 4,414,705 | 11/1983 | Ostrowsky | 220/339 |

*Primary Examiner*—S. Leon Bashore

*Assistant Examiner*—Michael K. Boyer

*Attorney, Agent, or Firm*—Toren, McGeady & Associates

[57] ABSTRACT

A plastic reaction vessel for holding a small quantity of liquid comprises a vessel body which has a body flange (4) surrounding an opening formed in the body, a cover, and a connecting strip (5) which is integral with the vessel body and the cover. Opposite to the connecting strip (5), the body flange (4) has a downwardly facing abutment surface (25), which is engageable by a hook-like extension (23), which is formed on the cover (6) and extends downwardly when the cover is closed. The connecting strip (5) comprises a hinge portion (12) between its opposite end portions. The cover comprise a cylindrical skirt, which is adapted to be inserted into the vessel body through the opening therein. A sealing lip (8) is provided on the outside of said skirt at that end thereof which is adapted to be inserted into the opening of the vessel body. The cover (6) has an outwardly protruding rim (16), from which a depending flange extends, which contacts the body flange so that a parallel guidance of the cover (6) is effected in conjunction with the hinge portion of the connecting strip. An alignment of the cover (6) is effected by the sealing lip (8), which is formed on the cylindrical skirt and in sealing contact with the inside surface of the vessel body.

12 Claims, 7 Drawing Figures

Fig. 1
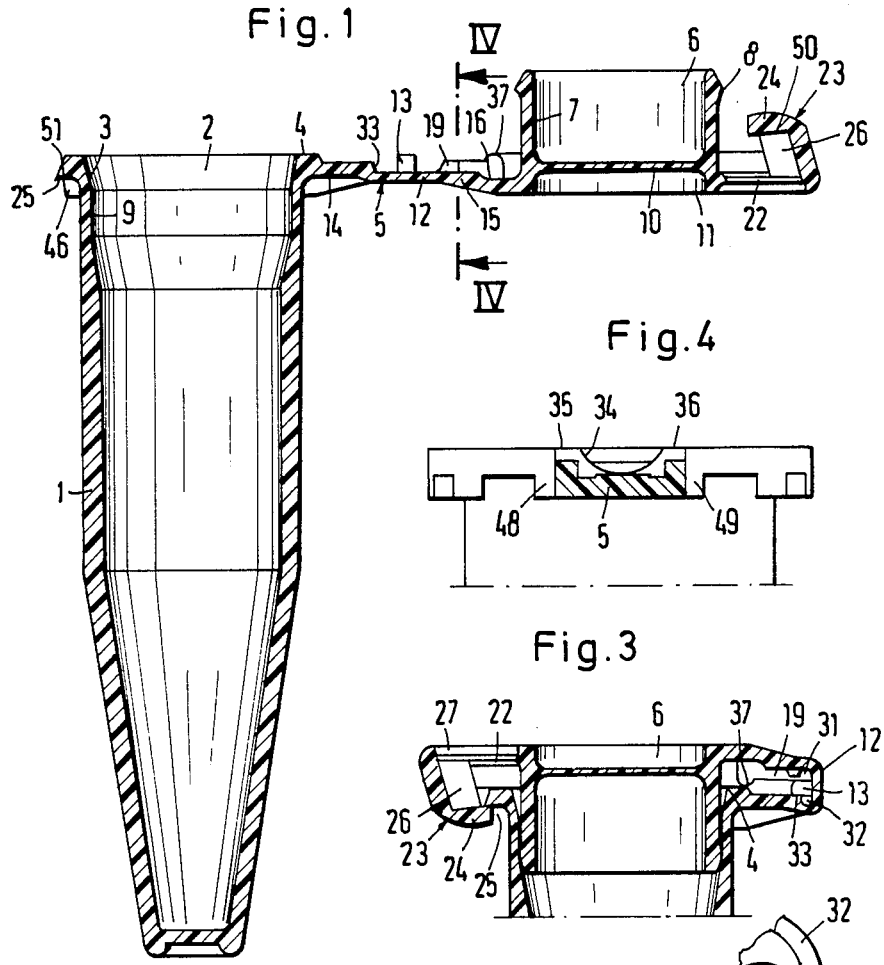
Fig. 4
Fig. 3
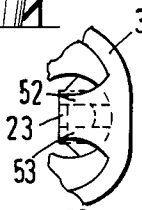
Fig. 7
Fig. 2
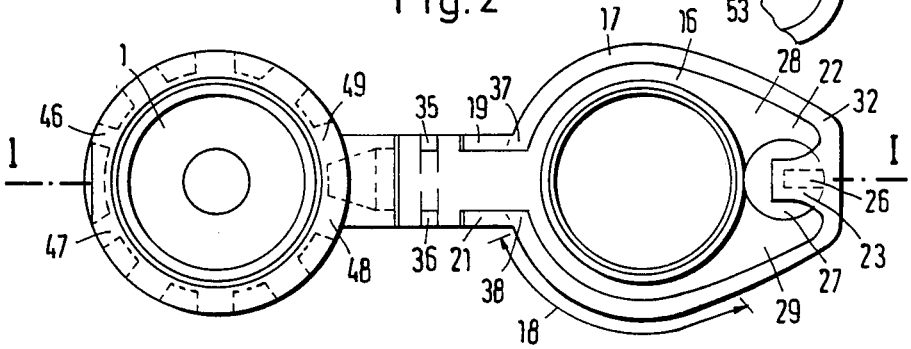

PLASTIC REACTION VESSEL

This is a continuation of application Ser. No. 686,198, filed Dec. 26, 1984, now abandoned.

BACKGROUND OF THE INVENTION

1. Field of the Invention

This invention relates to a plastic reaction vessel for holding a small quantity of liquid, comprising a vessel body having an edge portion which defines an opening, a cover, and a connecting strip which is integral with and connects said edge portion and said cover, which cover has an outwardly protruding rim, which when the opening is closed by the cover is in contact with said edge portion of the vessel body along a substantial portion of the periphery, and which cover has a cylindrical skirt, which is adapted to be inserted into the vessel body through the opening and from which the outwardly protruding rim extends like a flange, and which is provided with a sealing lip at that end of the skirt which is insertable into the vessel body through the opening.

The invention is also applicable to a reaction vessel in which the outwardly protruding rim of the cover is provided at its outer edge with a depending flange, which is generally parallel to the cylindrical skirt, and is engageable with the edge portion of the vessel body.

2. Description of the Prior Art

Reaction vessels provided with a cover are known from Laid-open German Application No. 17 73 331. In such vessels, important advantages are due to the fact that the cover cannot be lost.

The laid-open German application mentioned above discloses also a cover havinga cylindrical skirt, which is adapted to be inserted into the vessel body through the opening therein and from which the outwardly protruding rim extends like a flange. The outwardly protruding rim of the cover is provided with a protruding grip, which is opposite to the connecting strip.

In connection with such vessels it is also known to provide the vessel body with an opening which flares upwardly like a funnel so that the cylindrical skirt can smoothly be inserted. That skirt may be provided with an external sealing lip for engagement with a substantially cylindrical seating surface on the inside of the vessel body below the opening which is defined by the edge portion of the vessel body.

In vessels of the type described hereinbefore, the depending flange formed on the protruding rim of the cover serves to guide the cover on the edge portions of the vessel body and improves the stiffness of the vessel.

Particularly because such reaction vessels are often shipped while holding a liquid the cover should be held in its closed position not only by the engagement of a sealing lip with the inside peripheral surface of the vessel body but means should be provided by which the cover is reliably held in its closed position so that the action of forces which are inadvertently exerted on the cover in a lateral direction or in a different direction will not stress the sealing portions to such a degree that leaks can occur.

SUMMARY OF THE INVENTION

It is an object of the invention so to improve a reaction vessel of the kind described first hereinbefore that the vessel can easily be closed and opened by hand but presents a high resistance to being opened by an internal pressure and is provided with additional means for holding the cover in a closed position.

This object is accomplished in accordance with the invention in that the vessel body is provided at its edge portions with a flange, which has a downwardly facing abutment surface at a location which is diametrically opposite to the connecting strip, and the cover comprises a hooklike estension, which extends generally along said skirt and bears on said abutment surface when the cover is in its closed position, and that the connecting strip defines a hinge axis between its opposite ends.

Above said abutment surface, the flange of the vessel body has an outwardly facing, downwardly and outwardly inclined outside surface, which ensures that the hook-shaped extension will automatically be moved into engagement with the abutment surface as the cover is closed. the hook-shaped extension is so shaped that it will embrace the flange of the vessel body near the abutment surface, and means are provided for guiding said extension on its sides.

Because the connecting strip defines a hinge axis, the cover is laterally movable while the sealing lip of the cylindrical skirt is guided on the cylindrical inside surface of the vessel body.

The additional safety which is provided by the hooklike extension reduces the stress at the seal provided by the sealing lip of the closed cover so that lateral movements can also be taken up to some extent. In that respect the constraint provided by the connecting strip and the engagement between the hooklike extension and the abutment surface provide a stabilization whereas the hinge permits and adaptation.

In a particularly preferred embodiment the hinge comprises a double hinge, which permits a parallel guidance of the cover by the depending flange and a lateral movement of the cover, and the cover is movable with that parallel guidance in a height which corresponds to the length of the hooklike extension. In that case the cover is being aligned while the seal effected between the sealing lip and the cylindrical skirt is maintained.

This result will be further improved in that the connecting strip is provided between its ends with a projection, which protrudes inwardly when the connecting strip has been folded upon itself. That projection provides for a spacing and parallel guidance of the hinges which are formed at the adjacent sections of the connecting strip.

Owing to that parallel guidance, the folding of the connecting strip upon itself will not cause lateral forces to be exerted on the cover and will not influence the inclination of the cover. In such an arrangement, the region in which the strip is bent is particularly defined.

In a suitable embodiment providing such parallel guidance the connecting strip has an intermediate portion which is thinner than its end portions, which are integral with the cover and vessel body, respectively, and the end portion which is integral with the vessel body is provided near the vessel body with an upwardly protruding step facing away from the vessel body. The edge of said step may form a guide for the projection.

That concept results in a hinge which permits the connecting strip easily to be folded upon itself and which defnes the location of the bend in the connecting strip so that the cover will be further relieved.

It will be particularly advantageous to provide the depending flange near the connecting strip on opposite sides of the latter with extensions and at the radially inner end of said extensions with downwardly convex projections, which engage the flange of the vessel body when the cover has been applied to said body. When the cover is closed and the connecting strip has been folded upon itself, said convex projections engaging the vessel body contribute to the parallel guidance of the closed cover and also maintain the hooklike extension in engagement with the downwardly facing abutment surface. The downwardly convex projections may have such a height that they cooperate with the projection provided between the ends of the connecting strip so as to produce a certain initial stress by which the hooklike extension is urged against the downwardly facing abutment surface and on axial alignment of the closed cover is ensured.

The projection of the connecting strip suitably has a central aperture so that the projection is engaged only at its edges. This reduction of the contact surfaces will facility the adaptation.

In another embodiment the rim of the cover is provided with a projecting rip, which is diametrically opposite to the connecting strip, the hooklike extension depends preferably from the outer end of said grip, and the depending flange extends continuously past that end of the grip from which the hooklike extension extends. In that case the projecting grip will have a certain elasticity but will be able to guide the hooklike extension with an improved stability.

The yieldability of the projecting grip in conjunction with the lateral stability thereof is desirably improved further in that the projecting grip is formed with an opening so that the projecting grip has two spaced apart arms to which the hooklike extension is joined.

The hooklike extension is suitably stiffened by at least one rib adjacent to the projecting grip. If that rib is provided on the inside, it will stiffen the hooklike extension and owing to that stiffening will guide that extension toward the downwardly facing abutment surface of the flange of the vessel body.

A second rib may be provided. In that case the lateral stability of the hooklike extension can be improved in that the stiffening means are U-shaped in cross-section and comprise two ribs so that a boxsection-structure is virtually provided.

In another advantageous embodiment a central rib is provided on the outside. In that case the hooklike extension comprises a carrying portion, which is essentially parallel to the axis of the skirt and when the cover is closed extends close to the outer end of the downwardly facing abutment surface and closely embraces the adjacent portion of the depending flange.

Another embodiment comprises three ribs.

Particularly when the hooklike extension is designed to have lateral stability, e.g., by the stiffening means which provide a box-section structure, a desirable embodiment comprises a hooklike extension and a downwardly facing abutment surface having undercut surfaces in contact with each other. This will ensure that the hooklike extension will be more reliably held in position, particularly if that extension is designed to have lateral stability.

In a suitable embodiment at least one of the contacting surfaces of the hooklike extension and the downwardly facing abutment surface has a concavely curved portion at which said contacting surfaces interengage in such a manner that a certain lateral movement is permitted.

In another advantageous embodiment the contacting surfaces of the hooklike extension and of downwardly facing abutment surfaces extend at an angle to each other closely before they engage each other. This will also improve the interlock particularly in a direction which is radial to the axis of the vessel body.

In a preferred embodiment, the vessel body is formed on its outside surface with peripherally spaced apart merlon-shaped radial projections, which when the cover is closed are disposed under said depending flange and when the cover is closed the hooklike extension fits between two suitably spaced apart ones of said radial projections. This design will ensure a firm engagement.

In another desirable embodiment that portion of the hooklike extension which is engageable with the downwardly facing abutment surface and the outer edge of the flange of the vessel body near the downwardly facing abutment surface have arcuate edges which are concentric with the vessel body and contact each other when the cover is closed so that the cover will be held more firmly in position.

In a preferred embodiment, that edge of the downwardly facing abutment surface which faces the hooklike extension and the adjacent surface of the latter are concentrically curved with respect to the axis of the vessel body when the cover is closed. In that case a particularly effective guidance will be effected if at least one of the contacting surfaces of the hooklike extension and of the downwardly facing abutment surface has a concavely curved portion at which said contacting surfaces interengage.

In a manner known per se the transverse wall of the cover may be adapted to be pierced and may consist of plastic sheeting. That transverse wall of the cover is suitably disposed inside the cylindrical skirt close to that rim of said skirt which is at the top when the cover is closed.

In a preferred embodiment, the vessel body has a substantially cylindrical inside seating surface for engagement by the sealing lip provided on the cylindrical skirt and the shell of the vessel body has a relatively thick portion and has a relatively thin portion which includes said seating surface and extends as far as to the edge portion which defines said opening. In that case the vessel body will be able to adapt itself to the sealing lip with utilization of the above-mentioned parallel guidance of the interengageable parts.

The edge portion of the vessel body is suitably formed with an upwardly flaring inside surface, which defines the opening and facilitates the insertion of the sealing lip into the vessel body even if the sealing lip is an interference fit in said vessel body.

BRIEF DESCRIPTION OF THE DRAWING

FIG. 1 is an enlarged vertical sectional view taken on line I—I in FIG. 2 and showing a reaction vessel with the cover in an open position.

FIG. 2 is a top plan view showing the vessel of FIG. 1.

FIG. 3 is a sectional view which is similar to FIG. 1 but shows the upper portion of the vessel with the cover in closed position.

FIG. 4 is a sectional view taken on line IV—IV in FIG. 1.

FIG. 7 is a fragmentary view showing a modification of the right hand end portion of FIG. 2.

DESCRIPTION OF THE PREFERRED EMBODIMENTS

Figure 5:
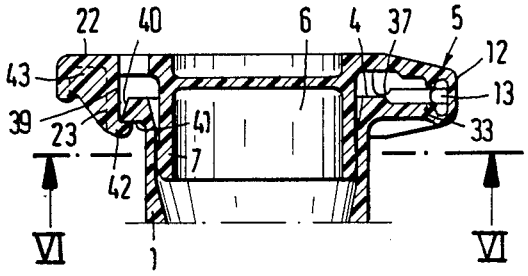
FIG. 5 is a view which is similar to FIG. 1 and shows another embodiment.

Illustrative embodiments of the invention will now be described with reference to the drawing.

The reaction body 1 of the reaction vessel is closed at its bottom and has at its top an opening 2, which is defined by an edge portion having an upwardly flaring, conical inside surface 3. The vessel body has a flange 4, which surrounds the opening 2. A connecting strip 5 extends from and is integral with the flange 4 and is also integral with a cover 6. The cover 6 comprises a cylindrical skirt 7, which is adpated to be inserted through the opening 2 into the vessel body 1 and to assume the position shown in FIG. 3, in which an outwardly protruding sealing lip 8 at the lower edge of the skirt 7 is in sealing contact with a substantially cylindrical seating surface 9 on the inside of the vessel body 1. Adjacent to the seating surface 9 the shell of the vessel body is thinner than in a lower portion so that manufacturing tolerances can be compensated by an adaptation.

The cover 6 has a transverse wall 10, which is disposed in the cylindrical skirt below the upper rin 11 thereof but is nearer to the upper rim 11 of the cylindrical skirt than to the sealing lip 8. The distance from the transverse wall 10 to the upper rim 11 is about one-third of the distance from the transverse wall 10 to the sealing lip 8.

The connecting strip 5 has an intermediate portion 12, which constitutes a hinge about which the connecting strip can be folded uon itself. The connecting strip is provided with a projection 13, which protrudes inwardly when the connecting strip has been folded upon itself and which holds the hinge-forming portions 31, 32 (FIG. 3) spaced apart. Said portions 31, 32 constitute a double hinge. The intermediate portion 12 of the connecting strip 5 is thinner than its end portions 14, 15, which are integral with the cover 6 and the vessel body 1, respectively. This design ensures that the connecting strip 5 will be folded upon itself about the hinge-forming portions 31, 32. The cylindrical skirt 7 is provided at its top with an outwardly protruding rim 16, from which a flange extends, which is generally parallel to the cylindrical skirt 7 and depends with the cover 6 is closed. For this reason the flange 17 will be described herein as a depending flange. When the cover is closed, the depending flange 17 engages the flange 4 of the vessel body. The depending flange 17 has a portion 18, which has the shape of an arc of a circle that is substantially concentric to the cylindrical skirt 7 and when the cover 6 is closed engages the flange 4 of the vessel body. Other portions of the depending flange 17 have stabilizing functions too. The depending flange 17 has extensions 19, 21, which extend from the portion 18 along the edges of the connecting strip 5 and terminate short of the projection 13 or at the adjacent end of the intermediate portion 12.

The depending flange 17 extends also along the outer edge of a projecting grip 22, which is formed on the cover 6 and is integral with a hooklike extension 23, which depends from the grip 22 when the cover 6 is closed. The hooklike extension has a hook portion 24, which engages a downwardly facing abutment surface 25 of the flange 4 of the vessel body 1. In the embodiment shown in FIGS. 1 to 4 the hooklike extension 23 is provided on its inside surface with a centrally disposed rib 26, which engages the flange 4 of the vessel body 1 and stiffens the extension 23. In the embodiment shown in FIG. 7 the extension 23 is formed on the inside with two ribs 52, 53, which engage the flange 4 of the vessel body and together with said flange 4 constitute a box-section structure for stiffening the hooklke extension 23 provided with the hook portion 24. Reference is made in this connection also to ribs 43 to 45 which are shown in FIG. 6 and improve the stability of the engagement between the hook portion 14 and the abutment surface 25.

Figure 6:
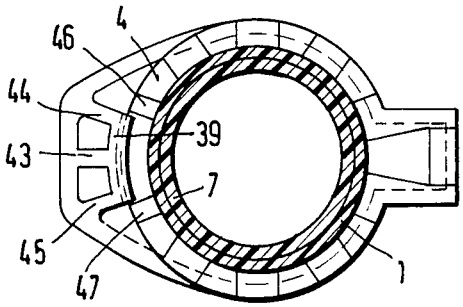
FIG. 6 is a vertical sectional view taken on line VI—VI in FIG. 5.

As is apparent from FIGS. 2, 4 and 6 the lateral guidance can be improved in that the vessel body 1 is formed on the outside with an annular series of radially protruding merlon-shaped projections, which are disposed under body flange 4. Two of said radial projections are shown at 46, 47 and are disposed on opposite sides of the hook portion 24 when the cover 6 is closed. FIG. 4 shows in a sectional view portions of two radial projections 48, 49, which are disposed on opposite sides of the connecting strip 5, as is shown more distinctly in FIG. 2. FIG. 1 shows the radial projection 46. Said radial projections improve the guidance of the cover 6, which is centered by the engagement of the sealing lip 8 with the seating surface of the vessel body. An advantage is afforded by the radial movement which is permitted by the projections 46 and 47. In one embodiment, these projections 46 and 47 permit also a limited lateral movement.

In accordance with FIGS. 1 and 3 the elasticity of the projecting grip 22 is improved in that is has a centrally disposed opening 27, by which the grip 23 is divided near the hooklike extension 23 into two arms 28, 29, which converge toward the hooklike extension 23.

The depending flange 17 may terminate on both sides of the projecting grip but is suitably continuous because its dimensions are so small that it ensures that the projecting grip will be sufficiently elastic. If a portion 32 of the depending flange is formed on the outer edge of the projecting grip, the outer portion of said grip will be strengthed so that a particularly high stability will be obtained particularly at the root of the hooklike extension 23.

In its thick leg 14, which is integral with the vessel body 1, the connecting strip 5 is formed with a step 33, which faces away from the vessel body, It is apparent from FIG. 3 that when the cover is closed the edge of that step 33, on the one hand, and the adjacent ends of the flange extension 19, 21, on the other hand, will constitute a guide above and below the projection 13 is an additional load is applied. Said parts also define the individual hinge axes of the double hinge.

In a desirable embodiment shown in FIG. 4 the conecting strip is formed with a centrally disposed aperture 34, which is shown in FIG. 4 so that the above-described guidance by the projection 13 is effected only at its edge portions 35, 36, which are disposed adjacent to the extensions 19, 21 of the depending flange 17. Each of the extensions 19, 21 of the depending flange 17 which are disposed near the connecting strip is provided with downwardly convex projections 37 or 38 at that end which is adjacent to the cover. Said convex projections may be constituted by the transitional portions between said extensions and the depending flange 17, which surrounds the cylindrical shirt 6 of the cover. In accordance with FIG. 3 said downwardly convex projections are in direct contact with the body flange 4 when the cover is closed so that an additional guidance of the cover is effected close to the rim of the opening 2, in addition to the parallel guidance effected by the projection 13 of its end portions adjacent tot he hinge.

In FIG. 5 and 6, like parts are designated with the same reference characters. The design is different adjacent to the projectin grip 22. In this embodiment the hooklike extension 23 comprises a carrying portion 39, which is substantially parallel to the axis of the skirt 6 and is formed with an edge portion which is substantially parallel to that axis and closely embraces that portion 40 of the body flange 4 which is formed with the downwardly facing abutment surface 25. Because the abutment surface 25 is provided on the underside of the body flange 4, the outer edge of that flange adjacent to the abutment surface 25 is concentric to the axis of the vessel body. that edge is designated 41 in FIG. 5. When the cover is closed, the carrying portion 39 and the hook portion 42 are curved to conform to the edge 41 and to the axis of the vessel. The downwardly facing abutment surface or that surface of the hook portion 42 which engages that abutment surface when the cover is closed is concavely curved at least in a radial direction with respect to the axis of the vessel body or skirt to form a part cylindrical recess in which said surfaces interengage. Particularly when the engaging parts are concentrically curved, that interengagement contributes to a lateral guidance in cooperation with the merlon-shaped projections 46, 47, which are provided on opposite sides of the abutment surface 41 on the outside surface of the vesel body 1 under its flange 4 and in cooperation with the double hinge serve to effect a stabilization by which an over-determination in view of the sealing lip 8 for centering the cover in its closed position is avoided. But protection is provided, particularly a guidance by which the seal is maintained even in case of lateral impacts from the outside.

Because the carrying portion 39 has an edge in contact with the body flange 4, the hooklike extension 23 is provided in this embodiment with ribs on the outside. In the present embodiment, three ribs 43 to 45 ar eprovided and constitute a box-section or honeycomb structure on the hooklike extension 23 provided on the projecting grip. As a result, the hooklike extension has a high lateral stability at its projection hook but is deflectable in the plane of the transverse wall of the cover. An advantage is due to the fact that the outer ribs 44, 45 can engage the merlon-shaped projections 46, 47.

FIG. 5 shows a concave surface formed on the hook portion 24 or on the downwardly facing abutment surface 41. In the embodiment shown in FIGS. 1 to 3 the hook portion 24 and the downwardly facing abutment surface are formed with surfaces 50, 51, respectively, which extend at an angle to each other closely before they engage each other. That design will improve the interengagement of the undercut surfaces. The term 'undercut' describes the fact that when the cover is closed the downwardly facing abutment surface 25 of the body flange 4 is downwardly and outwardly inclined toward its free end and that surface 41 with which the hook portion 24 engages the abutment surface 25 is upwardly and inwardly inclined toward its free end.

We claim:

1. In a plastic reaction vessel comprising a hollow vessel body having an inside peripheral surface and an edge portion which defines an opeing (2) adjoining said surface, a cover comprising a cylindrical skirt which extends through said opening into said vesssel body and is removable therefrom and has an inner end provided with a sealing lip (8) in sealing contact with said inside peripheral surface, said cover having a radially outwardly protruding rim which is axially spaced from said sealing lip and contacts said edge portion along a substantial part of the peripheral extent of the edge portion, said cover also comprising a transverse wall, said wall axially spaced from said sealing lip and closing said skirt, and a flexible connecting strip (5) having opposite ends that are respectively integral with said vessel body and said cover, said connecting strip permitting said skirt to be removed from said vessel through said opening, the improvement comprising that said vessel body comprises a body flange (4) which surrounds said edge portion, said flange defining a downwardly facing abutment surface (25, 41) extending radially outwardly from said vessel body at a location which is diametrically opposite to said connecting strip, said cover comprises a hooklike extension (23) which is attached to said body flange and spaced radially outwardly from said skirt and releasably engages said abutment surface, said connecting strip comprises a hinge portion (12) defining between said opposite ends at least one laterally extending hinge axis, said cover comprises a depending flange extending downwardly from the outer edge of said rim and contacting the periphery of said body flange, wherein said hinge portion of said connecting strip comprises two hinges (31, 32) spaced apart along said strip, so that in conjunction with said depending flange said hinge portion permits a lateral movement of said cover whereas a parallel guidance of said cover is effected by said depending flange in contact with said body flange, said hinges spaced such a distance apart that said parallel guidance is provided in a height which corresponds to the length of said hooklike extension, and an alignment of the cover is effected by the contact of said sealing lip with said inside surface, and wherein said hinge portion (12) is provided with an inwardly protruding projection (13) attached to said hinge portion (12) of said connecting strip and located between said hinges, said projection (13) serving for holding said hinges (31, 32) spaced apart and for effecting a parallel guidance by means of said hinges, and wherein said hinge portion (12) is thinner between said hinges than those portions (14, 15) of said connecting strip which extend from said hinge portion to said vessel body (1) and said cover (6), respectively, and an upwardly protruding step (33) facing away from said vessel body is formed in said portion which extends from said hinge portion to said vessel body.

2. The reaction vessel set forth in claim 1, wherein said depending flange (17) has extensions (19, 21), which extend close to and along opposite sides of said connecting strip (5) and said depending flange (17) is fomred at its lower edge at the radially inner end of each of said extensions with a downwardly convex projection (37, 38) engaging said body flange (4).

3. The reaction vessel set forth in claim 1, wherein said projection (13) of said connecting strip (5) is formed with a centrally disposed aperture (34).

4. The reaction vessel set forth in claim 1, wherein said rim of said cover is provided with a projecting grip (22) located diametrically opposite of said connecting strip, said depending flange (17) has a portion formed under and depending from said outer end of said projecting grip (22), and wherein said projecting grip (22) is formed with at least one aperture (27) which is defined by two projecting arms (28, 29) of said grip and said hooklike extension (23) is joined to said grip at the outer ends of said arms.

5. The reaction vessel set forth in claim 4, wherein said hooklike extension (23) is formed with stiffening rib means (26, 43, 44, 45, 46, 47) extending from said hooklike extension to said projecting grip (23).

6. The reaction vessel set forth in claim 5, wherein said hooklike extension is substantially U-shaped in cross-section and provided with two of said ribs (46, 47).

7. The reaction vessel set forth in claim 5, wherein said stiffening rib means comprise at least one rib (43) provided on the outside of said hooklike extension at the center of its width.

8. The reaction vessel set forth in claim 5, wherein said rib means comprise three ribs (43–45).

9. The reaction vessel set forth in claim 1, wherein said hooklike extension (23, 42) and said downwardly facing abutment surface (25, 41) comprise undercut surface portions which contact each other and are inclined from the axis of said skirt and of said vessel body, and wherein at least one of said undercut surface portions has a concavely curved surface portion and said undercut surface portions interengage at said concavely curved surface portion.

10. The reaction vessel set forth in claim 1, wherein said vessel body is provided on the outside with merlon-shaped radial projections below said body flange, wherein two of said merlon-shaped projections (46, 47) are close to said hooklike extension (23) on opposite sides thereof.

11. The reaction vessel set forth in claim 1, wherein said transverse wall is adapted to be pierced, said inside surfce of said vessel body comprises a cylindrical seating surface portion (9) disposed below said opening and in sealing contact with said sealing lip (8) of the cylindrical skirt (7), and said vessel body comprises a shell having a relativley thin-walled portion formed with said seating surface and extending to said edge portion (3) and a relatively thick-walled portion on the side of said seating surface which is opposite to said edge portion (3).

12. The reaction vessel set forth in claim 1, wherein said body flange (4) has adjacent to said abutment surface (25, 41) a first curved edge portion, said hooklike extension (23) comprises a hook portion (24) having a second curved edge portion in contact with said first curved edge portions and said first and second curved edge portions are concentric to the axis of said vessel body.

* * * * *